US006491196B1

(12) United States Patent
Coler

(10) Patent No.: US 6,491,196 B1
(45) Date of Patent: Dec. 10, 2002

(54) YOGA MAT HOLDER

(76) Inventor: Maria Coler, 402 Grand St., Apt. 2, Hoboken, NJ (US) 07030

( * ) Notice: Subject to any disclaimer, the term of this patent is extended or adjusted under 35 U.S.C. 154(b) by 0 days.

(21) Appl. No.: 09/526,072

(22) Filed: Mar. 15, 2000

(51) Int. Cl.[7] ..... A45C 13/30

(52) U.S. Cl. ..... 224/602; 224/250; 224/258; 224/647; 224/648; 224/651; 224/901.6

(58) Field of Search ..... 224/577, 601, 224/602, 603, 606, 607, 625, 626, 231, 250, 251, 258, 647, 648, 651, 652, 660, 236, 901.6

(56) References Cited

U.S. PATENT DOCUMENTS 2,502,033 A * 3/1950 Bohn ..... 224/250 X
4,518,107 A * 5/1985 Amos ..... 224/215
5,238,162 A * 8/1993 LaCivita ..... 224/250
5,265,784 A * 11/1993 Gregory ..... 224/254 X
5,400,937 A * 3/1995 Rottenberg ..... 224/258
5,450,991 A * 9/1995 Neading ..... 224/250 X
5,642,842 A * 7/1997 Taras ..... 224/250
6,126,054 A * 10/2000 Reimer ..... 224/601

OTHER PUBLICATIONS

Advertisement for yogabags by Barefoot Yoga Co. No date.
Advertisement for yoga bags by Hugger Mugger Yoga Products, No date.

* cited by examiner

*Primary Examiner*—Stephen K. Cronin
(74) *Attorney, Agent, or Firm*—Reed Smith LLP

(57) ABSTRACT

A yoga mat holder is provided with a diamond-shaped leaf to hold a rolled-up yoga mat. The yoga mat holder has a quick-release buckle and webbing attached to the leaf to fasten the yoga mat to the diamond-shaped leaf. The yoga mat holder also has a shoulder strap and a waist strap attached to an adjustable webbing with another quick-release buckle to secure the holder across the chest of the wearer. The diamond-shaped leaf is folded around the rolled-up yoga mat and worn diagonally across the back of a person. Pockets are provided on the shoulder and waist straps to allow a person to access her belongings without removing or shifting the position of the holder.

19 Claims, 6 Drawing Sheets

• SHOULDER STRAP DETAILS

YOGA MAT HOLDER

FIELD OF INVENTION

The present invention relates to an article holder and, more specifically, to a holder for carrying a rolled-up yoga mat on the back of a user.

BACKGROUND OF THE INVENTION

The main piece of equipment used by the yoga practitioner is a "sticky" mat or yoga mat. The practitioner performs various exercises required of this discipline on the yoga mat. The yoga mat is typically 24"×72" and is made of a textured rubber material with a special coating to create a slip-free or sticky finish. The yoga mat is usually rolled into a cylinder and carried to and from the center where yoga is practiced. The diameter of the typical rolled-up yoga mat is approximately 4.5 inches and the height remains 24 inches.

It is desirable for a yoga mat holder to fulfill the following functions:

1. It is desirable to carry a yoga mat in a non-cumbersome manner while leaving the hands free.
2. It is desirable to provide a carrier that adequately protects the yoga mat from wear and tear and still exposes the yoga mat to the air for hygienic reasons;
3. It is desirable for the yoga mat holder to allow for quick-release of the yoga mat from the holder and the holder from the user;
4. It is desirable to provide a carrier that enables the user to easily access her personal belongings without shifting the position of the carrier.

Conventional backpacks allow the mat to be transported while leaving the hands free. These backpacks, however, are not feasible in allowing the user to carry the bulky yoga mat in a non-cumbersome manner. By placing a rolled-up yoga mat in a conventional backpack, the yoga mat will stick out of the enclosed area of the bag. The extension of the yoga mat out of the bag creates a problem as the yoga practitioner must account for an additional height added by the protruding mat. In addition, the yoga mat is not firmly secured within the backpack, allowing the yoga mat to be easily jostled in any direction. The protruding portion of the yoga mat is vulnerable to wear and tear caused by contact with other objects. A practitioner may fold the mat so that it will fit within the enclosed area of the backpack. Placing a mat that has recently been in contact with sweat from the practitioner into an enclosed area delays the evaporation of sweat and can create hygiene concerns for both the mat and the backpack. Another problem that exists with the conventional backpack is the accessibility of pockets where personal items are stored. The pockets on a backpack are usually placed on the front of the bag. Consequently, the personal belongings of the user are not easily accessible without shifting the backpack on, or removing it from, its position on the user's body.

Another device that can be used to carry a rolled-up yoga mat is a cylindrical-shaped sack with a top-loading drawstring or side-loading zipper. The sack is strung over the user's shoulder or across the body with one strap. This device is not feasible in allowing the user to carry the bulky yoga mat in a non-cumbersome manner. If the user bends, reaches or suddenly turns, the yoga mat holder can swing from the body. By placing a rolled-up yoga mat that has recently been in contact with sweat from the practitioner into an enclosed area, the evaporation of sweat is delayed. This creates hygiene concerns for both the mat and the sack. Although several varieties of the sack device include pockets located on the sack, the personal belongings of the user are not easily accessible without shifting the sack on, or removing the sack from, its position on the user's body.

A solitary strap can also be used to hold yoga mats. This strap is wrapped around each end of the mat with two fastening mechanisms. The strap is either strung over the user's shoulder or across the body. This device is not feasible in allowing the user to carry the bulky yoga mat in a non-cumbersome manner. If the user bends, reaches or suddenly turns, the yoga mat holder can swing from the body. In addition, the mat is fully exposed and, therefore, vulnerable to wear and tear. The solitary strap does not contain pockets for the purpose of holding the user's personal belongings.

SUMMARY OF THE INVENTION

Therefore, it is among the main objects of the invention to provide a yoga mat holder which will allow the user to carry a rolled-up yoga mat in a convenient manner without encumbering the user.

It is another object of the invention to allow the user to expose the mat to the air while protecting the mat from wear and tear during transport. It is another object of the invention to allow the user to quickly detach the mat from the holder and the holder from herself It is another object of the invention to allow the user to easily access her belongings without shifting the position of the carrier.

Briefly, the invention provides a yoga mat holder that includes a diamond-shaped leaf for retaining a rolled-up yoga mat. Webbing and a quick-release buckle are used to firmly secure the rolled-up mat to the diamond-shaped leaf for easy and comfortable transport. Waist and shoulder straps are connected to the diamond-shaped leaf for securing the rolled-up yoga mat in the diamond-shaped leaf to the user. The straps are connected together across the front of the user from shoulder to opposite hip. The securing mechanism uses a quick-release buckle connected to adjustable webbing. The diamond-shaped leaf is also oriented diagonally across the back of the user.

The aforementioned objects, and other obvious advantages of the present invention will become apparent by reference to the following detailed description and to the annexed drawings therein.

DETAILED DESCRIPTION OF THE INVENTION

Figure 1:
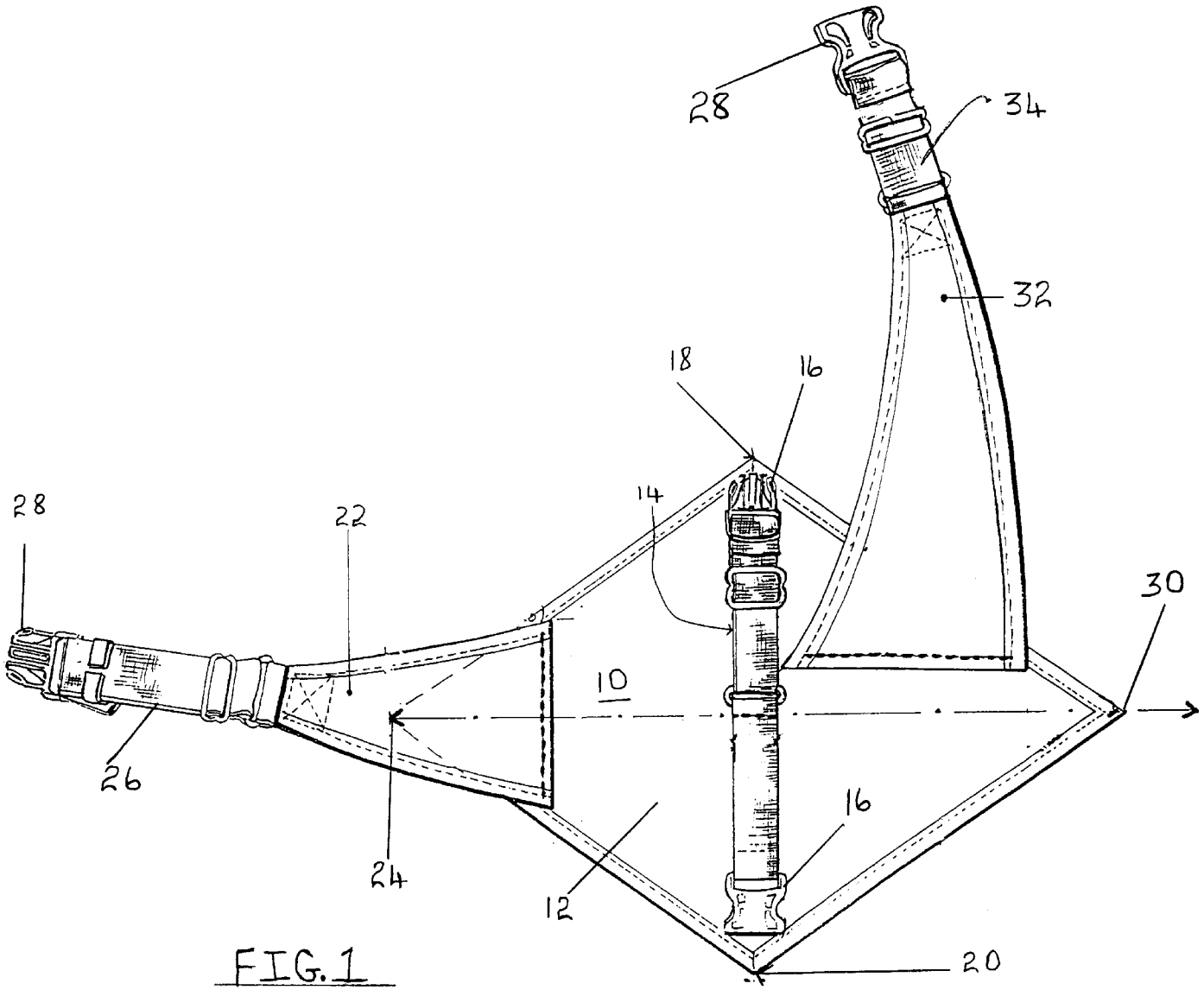
FIG. 1 is a front view of one embodiment of the yoga mat holder in accordance with the present invention.
Figure 2:
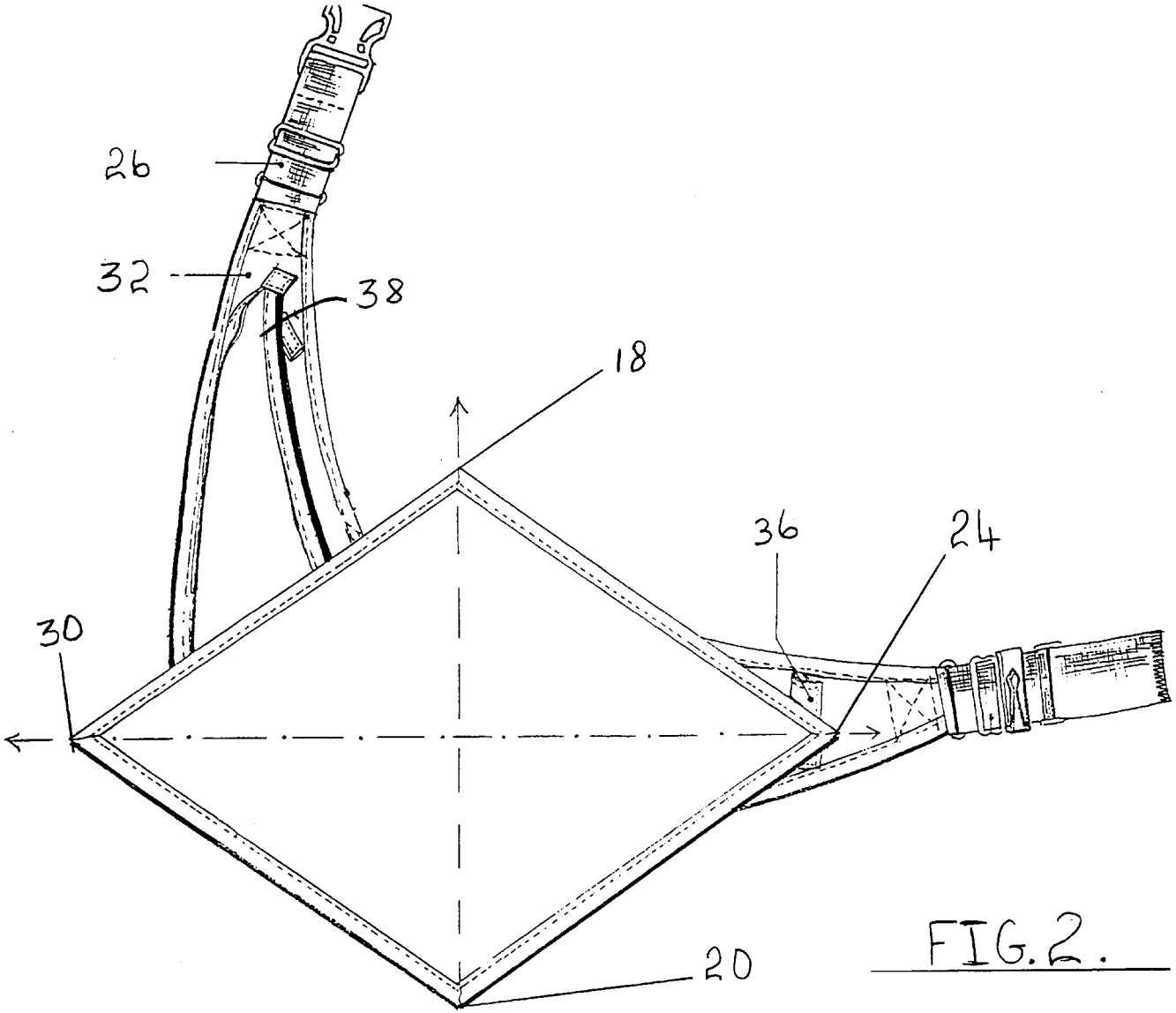
FIG. 2 is a back view of one embodiment of the yoga mat holder in accordance with the present invention.

FIGS. 1 and 2 depict front and back views of the yoga mat holder. Referring to FIG. 1, the yoga mat holder 10 includes a flexible retainer such as a diamond-shaped leaf 12 that will be used to retain a rolled-up yoga mat. The diamond-shaped leaf is made with a non-slip material that is sewn to a padded material. The padded material consists of any type of durable material fused to padding.

A webbing 14 with a quick-release buckle 16 is attached to the diamond-shaped leaf 12. The webbing 14 is aligned along the center line between two opposing corners 18, 20 of the diamond-shaped leaf. The quick-release buckles 16 can be of any type of connecting device that allows the adjustment of the length of the webbing 14 and has the strength to remain connected while being carried.

A shoulder strap 22 is attached at a third corner 24 of the diamond-shaped leaf 12. The shoulder strap 22 is composed of the same material as the diamond-shaped leaf. The shoulder strap 22 is attached to a webbing 26 which is attached to a buckle 28. The shoulder strap can potentially be altered to accommodate different needs by widening the area of the strap that rests on the shoulder or adding more padding to the shoulder area.

Located near one edge of the diamond-shaped leaf 12 close to the fourth corner 30, a waist strap 32 is attached to the diamond-shaped leaf 12. The waist strap 32 is also connected to a webbing 34 with the quick-release buckle 28. The waist strap 32 is also constructed of the same material as the shoulder strap and diamond-shaped leaf. Similar to the shoulder strap, the width of the waist strap could potentially be altered.

Referring to FIG. 2, the front view of the yoga mat holder can be seen. The shoulder strap and the waist strap can have containers to hold personal belongings. On the shoulder strap, a shoulder pocket 36 is sewn directly onto the material of the shoulder strap 22. A gusset pocket 38 forms the front face of the waist strap 32 to provide storage space.

Figure 3:
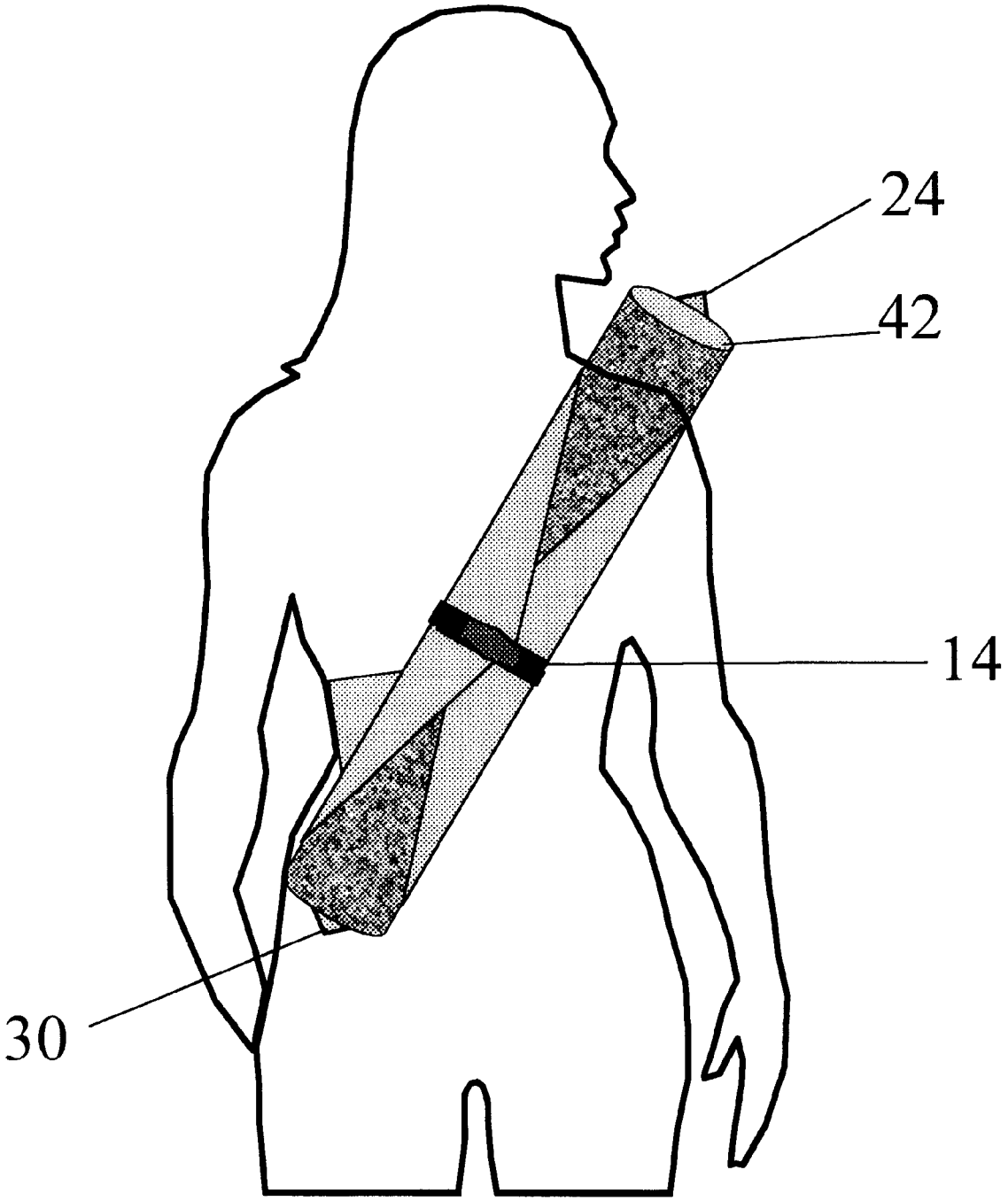
FIG. 3 is a back view of a person wearing the yoga mat holder with the rolled-up yoga mat.

Referring to FIG. 3, the operation of the yoga mat holder 10 in retaining a rolled-up yoga mat 42 can be seen. A rolled-up yoga mat 42 is placed along the centerline between the third and fourth corners 24, 30 of the diamond-shaped leaf 12. The diamond-shaped leaf 12 is then wrapped around the mat. The webbing 14 that extends along the centerline, around the diamond-shaped leaf, between the first and second corners 18, 20, is connected by a quick-release buckle to secure the mat. The webbing is then adjusted to tighten the hold on the mat.

The diamond-shaped leaf 12 covers much of the mat while still exposing it to the air. In particular, both ends of the cylindrically shaped mat are exposed while a large portion of the circumferential surface of the mat is protected by the diamond-shaped leaf 12. Exposing both ends of the mat also allows the height of the mat to be adjusted within the holder. Before tightening the buckle, the mat can be shifted within the holder 10 to adjust the portions of the mat that will extend from either side. If a particular user wishes the mat to protrude more from the bottom of the holder than the top, the user can simply move the mat further down in the holder 10 before tightening the buckles.

When being retained in this manner, the rolled-up yoga mat is affixed to the holder 10 along the center line of the diamond-shaped leaf 12. This orientation is secure despite the use of only one buckle 16 to secure the mat because of the non-slip material and the wrapping mechanism of the diamond-shaped leaf 12. This stabilizes the mat, preventing it from being jostled within the holder 10 during transport. Not only is the tightness of the wrap adjustable, but the wrap is made of non-slip material. Affixing the mat along the center line of the diamond-shaped leaf 12 also allows the orientation of the mat on the user's body to be fixed when securing the holder 10 to the user.

Figure 4:
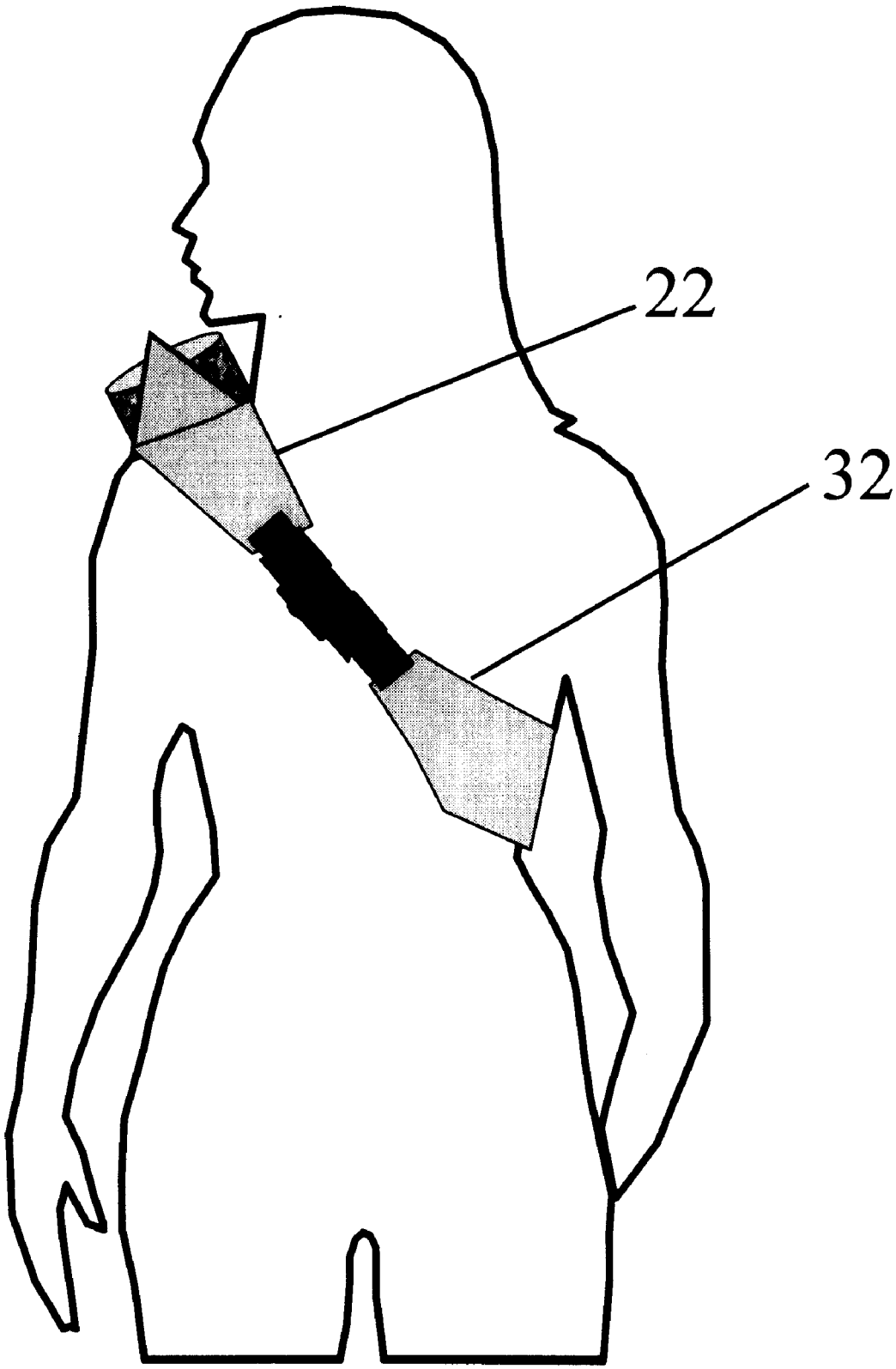
FIG. 4 is a front view of a person wearing the yoga mat holder with the rolled-up yoga mat included.

Referring to FIG. 4, the manner in which the holder 10 is secured to the user is depicted. The waist strap 32 is wrapped around the waist of the user while the shoulder strap 22 is wrapped over the shoulder of the user. Both shoulder and waist straps meet in the middle of the user's body and are connected to adjustable webbing. The webbing is fastened by a quick-release buckle 28. The webbing is then adjusted to firmly secure the holder 10 to the user's body. Orienting the waist strap 32 and shoulder strap 22 across the body allows the holder to rest comfortably and snugly on the body. In addition, the cross-wise orientation forces the rolled up mat to lie diagonally across the back. By holding the rolled up mat diagonally across the back, the amount of the mat extending beyond the body is minimized.

The yoga mat holder is ergonomically designed. Conventional backpacks cause a majority of the weight to be primarily carried on the shoulders. By strapping the holder across the body of the user with the waist and shoulder straps, the weight is more equally distributed across the body. In addition, the holder 10 is also stabilized on the body because both the waist and shoulder straps cause the holder to be held tighter to the body than conventional backpacks and other yoga mat holders on the market. The combination of securely fixing the rolled-up yoga mat to the holder and tightly binding the holder to the person minimizes the awkwardness of carrying the bulky mat by making the carried mat more integral to the body of the carrier.

Figure 5B:
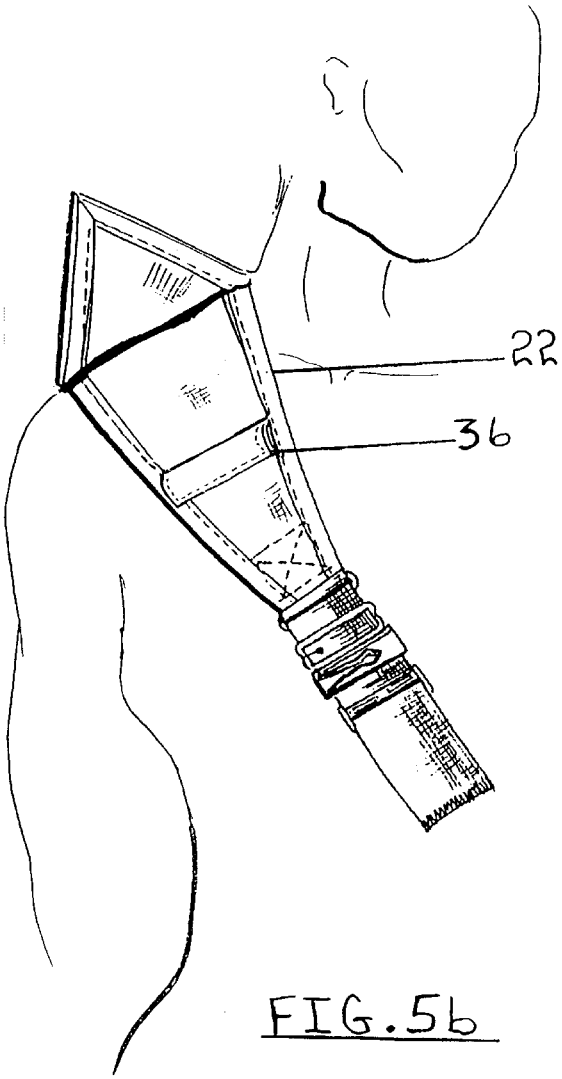
FIG. 5*b* is a perspective view of the shoulder strap wrapped around a person wearing the yoga mat holder.
Figure 5A:
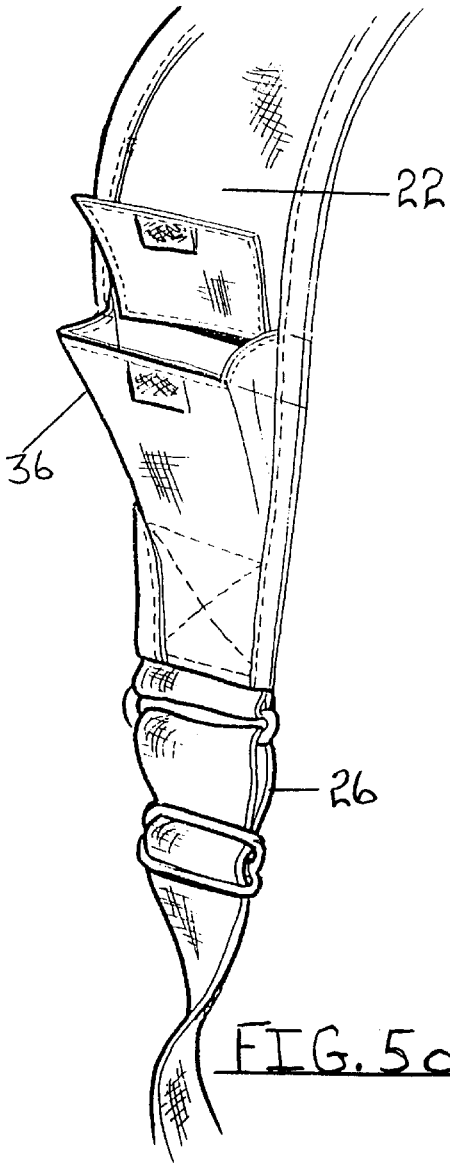
FIG. 5*a* is a detailed view of the shoulder strap with a pocket.

FIG. 5*a* depicts the shoulder strap in greater detail. Shoulder pocket 36 is placed on the end of the strap closer to the webbing 26 and quick-release buckle 28. The shoulder pocket 36 extends most of the width of the strap. The shoulder pocket uses a velcro strip to close the pocket, but any quick fastener can be utilized. FIG. 5*b* demonstrates the position of the pocket 36 when the yoga mat holder is worn by the user. As depicted, the shoulder pocket 36 rests on the chest of the user. This location makes the pocket and its contents accessible to the user while carrying the yoga mat holder. The user does not have to take off or shift the yoga mat holder to to access the pocket.

Figure 6A:
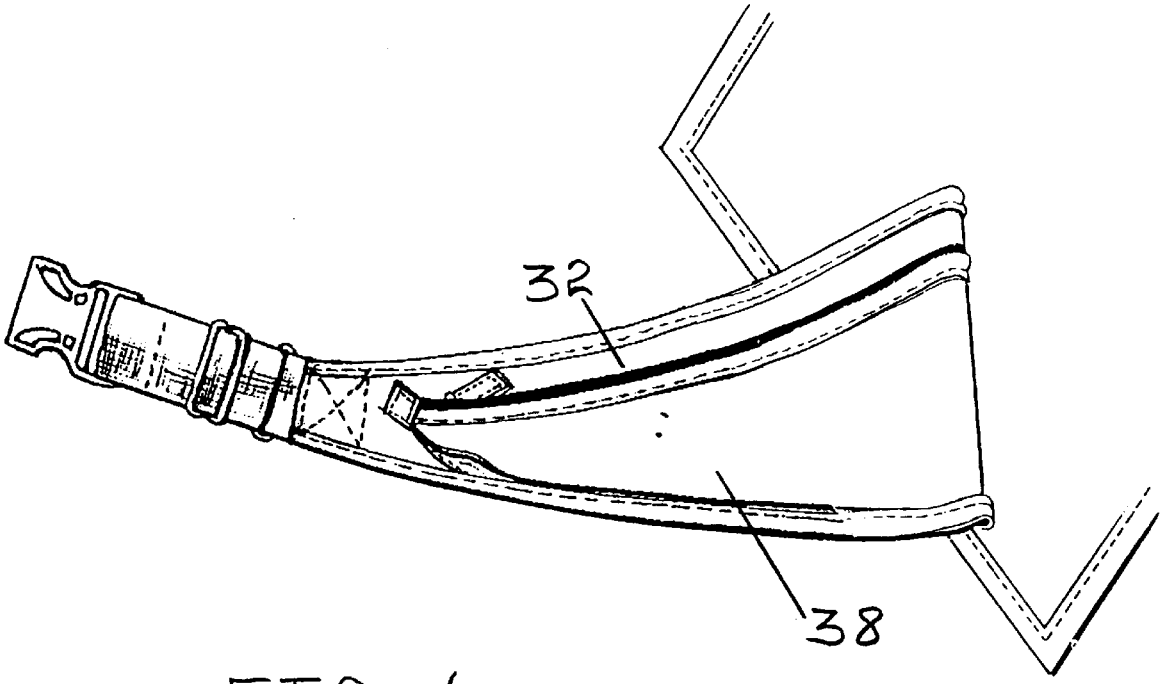
FIG. 6*a* is a detailed view of the waist strap with a pocket.
Figure 6B:
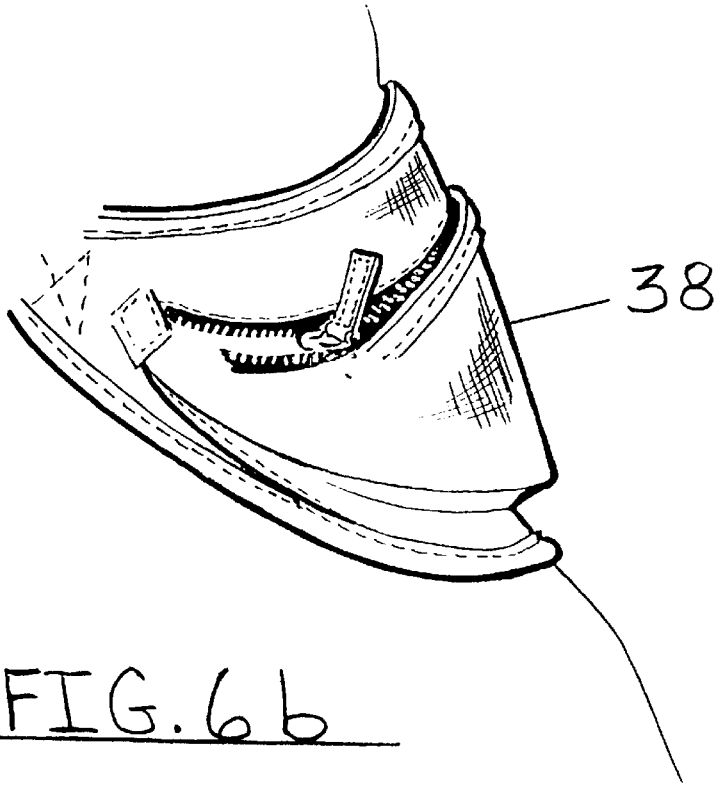
FIG. 6*b* is perspective view depicting the waist strap wrapped around a person wearing the yoga mat holder.

FIG. 6*a* shows the waist strap with the gusset pocket 38 in greater detail. The gusset pocket 38 extends along the waist strap and spans most of the width of the waist strap. The opening of the pocket is closed by a zipper that also extends along the waist strap. The gusset pocket 38 can expand to provide greater storage space. FIG. 6*b* shows the positioning of the gusset pocket when the yoga mat holder is worn by a user. The gusset pocket 38 wraps around the waist, keeping the pocket (even when expanded) close to the body. Wrapping the pocket around the waist does not decrease the accessibility of the pocket to the user since the zipper tab is located at the front of the strap.

The present invention is not to be considered limited in scope by the preferred embodiments described in the specification. Additional advantages and modifications, which will readily occur to those skilled in the art from consideration of the specification and practice of the invention, are intended to be within the scope and spirit of the following claims.

What is claimed is:

1. A yoga mat holder comprising:

a flexible retainer capable of wrapping around a rolled-up yoga mat;

a first fastener attached to said retainer to allow said retainer to hold said rolled-up yoga mat in said holder;

a second fastener attached to said retainer to ensure that said holder remains on a person carrying said holder; and wherein said second fastener further comprises a strap attached to said retainer; said strap being capable of wrapping around a person when said retainer is wrapped around said rolled-up yoga mat; said strap extending from said retainer in a first direction and a second direction; said first direction and said second direction forming an angle substantially less than 180 degrees.

2. A yoga mat holder as claimed in claim 1, wherein said first fastener further comprises a webbing attached to said retainer; said webbing being capable of wrapping around said retainer when said retainer is wrapped around said yoga mat.

3. A yoga mat holder as claimed in claim 1, wherein said strap further comprises pockets.

4. A yoga mat holder as claimed in claim 1, wherein said holder includes padded material to cushion said holder against said person's body.

5. A yoga mat holder as claimed in claim 1, wherein said retainer is a diamond-shaped leaf.

6. A yoga mat holder as claimed in claim 1, wherein said retainer will be oriented diagonally across said person's back when said retainer is wrapped around a rolled-up yoga mat and said holder is attached to said person.

7. A yoga mat holder as claimed in claim 1, wherein said strap is ergonomically designed to allow the holder to be carried in a non-cumbersome manner.

8. A yoga mat holder as claimed in claim 1, wherein said first and second fasteners further comprise an adjustable webbing and quick-release buckles.

9. A yoga mat holder as claimed in claim 1, wherein said retainer is capable of holding a rolled up yoga mat that is longer than said retainer.

10. A yoga mat holder as claimed in claim 1, wherein said retainer is capable of holding a rolled-up yoga mat while allowing the rolled-up yoga mat to be exposed to air at its ends when said retainer is wrapped around said rolled-up yoga mat.

11. A yoga mat holder as claimed in claim 1, further comprising a rolled-up yoga mat wherein said retainer covers a substantial portion of a rolled-up yoga mat when said retainer is wrapped around said rolled-up yoga mat.

12. A yoga mat holder as claimed in claim 1, wherein said strap further comprises:

a shoulder strap portion attached to said retainer; and a waist strap portion attached to said retainer; said shoulder strap portion and said waist strap portion being capable of joining together by said second fastener.

13. A yoga mat holder as claimed in claim 12, wherein said shoulder strap portion can wrap around said person's shoulder and said waist strap portion can wrap around said person's waist.

14. A yoga mat holder comprising:

a flexible retainer having four corners;

a webbing attached to said retainer and extending along a center line between a first and second comer of said retainer, said first and second corners being opposite each other;

shoulder strap attached to said retainer and extending away from a third corner of said retainer, waist strap attached to said retainer;

a first fastener attached to said webbing; and a second fastener attached to said shoulder strap and waist strap.

15. A yoga mat holder as claimed in claim 14, wherein said waist strap extends away from said retainer from a position between a fourth corner and said second corner.

16. A yoga mat holder as claimed in claim 14, wherein said retainer is diamond-shaped.

17. A yoga mat holder as claimed in claim 16, wherein the distance between said first and second corners is shorter than the distance between said third and fourth corners.

18. A yoga mat holder as claimed in claim 17, further comprising a rolled up yoga mat wherein said distance between said third and fourth corners is slightly longer than said rolled-up yoga mat.

19. A yoga mat holder comprising:

a flexible retainer; said retainer having a first and second axes; said first axis being perpendicular to said second axis;

a webbing attached to said retainer and extending along said first axis;

a shoulder strap attached to said retainer along said second axis and extending from said retainer;

a waist strap attached to said retainer;

a first fastener attached to said webbing; and a second fastener attached to said shoulder strap and waist strap.

* * * * *